US009936730B2

(12) United States Patent
Carraro et al.

(10) Patent No.: US 9,936,730 B2
(45) Date of Patent: Apr. 10, 2018

(54) METHOD AND APPARATUS FOR MANUFACTURING SMOKING ARTICLE COMPONENTS HAVING A REMOVABLE WRAP

(71) Applicant: Philip Morris Products S.A., Neuchatel (CH)

(72) Inventors: Andrea Carraro, Ins (CH); Alexis Louvet, Lausanne (CH); Oleg Mironov, Neuchatel (CH); Christopher John Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/439,071

(22) PCT Filed: Dec. 6, 2013

(86) PCT No.: PCT/EP2013/075856
§ 371 (c)(1),
(2) Date: Apr. 28, 2015

(87) PCT Pub. No.: WO2014/086999
PCT Pub. Date: Jun. 12, 2016

(65) Prior Publication Data

US 2015/0289566 A1 Oct. 15, 2015

(30) Foreign Application Priority Data

Dec. 7, 2012 (EP) ..... 12196194
Dec. 10, 2012 (EP) ..... 12196395

(51) Int. Cl.
*A24F 47/00* (2006.01)
*A24D 3/02* (2006.01)
(Continued)

(52) U.S. Cl.
CPC ..... *A24F 47/006* (2013.01); *A24C 5/007* (2013.01); *A24C 5/10* (2013.01); *A24C 5/47* (2013.01); *A24D 3/0287* (2013.01)

(58) Field of Classification Search
None
See application file for complete search history.

(56) References Cited

U.S. PATENT DOCUMENTS 1,963,738 A * 6/1934 Elow ..... A24D 1/042 131/331
2,104,329 A 1/1938 Levy
(Continued)

FOREIGN PATENT DOCUMENTS

CN 1046664 A 11/1990
CN 101778578 A 7/2010
(Continued)

OTHER PUBLICATIONS

Combined Chinese Office Action and Search Report dated Jan. 3, 2017 in Patent Application No. 201380063355.9 (with English translation).
(Continued)

*Primary Examiner* — Alison L Hindenlang
*Assistant Examiner* — Jamel M Nelson
(74) *Attorney, Agent, or Firm* — Oblon, McClelland, Maier & Neustadt, L.L.P.

(57) ABSTRACT

A method and apparatus are provided for manufacturing multi-component segments for smoking articles, each having a removable wrap. The method includes feeding a stream of heat sources and aerosol-forming substrates along a moving delivery path; compacting into groups at least one heat source and an aerosol-forming substrate, each group corresponding to at least one multi-segment component, each multi-segment component having a first end adjacent
(Continued)

the heat source and a second end adjacent the aerosol-forming substrate; wrapping the heat sources and aerosol-forming substrates in a web of material, said web having spaced apart lines of weakness; aligning each line of weakness proximate to a respective heat source; and cutting said web at a position proximate to the first end of the at least one multi-segment component, wherein at least a portion of said web forms a removable wrap being removable by breaking the wrapper at the respective line of weakness.

12 Claims, 3 Drawing Sheets

(51) Int. Cl.

| | |
|---|---|
| ***A24C 5/00*** | (2006.01) |
| ***A24C 5/10*** | (2006.01) |
| ***A24C 5/47*** | (2006.01) |

(56) References Cited

U.S. PATENT DOCUMENTS

| | | | | |
|---|---|---|---|---|
| 4,714,082 | A | 12/1987 | Banerjee et al. | |
| 4,793,365 | A | 12/1988 | Sensabaugh, Jr. et al. | |
| 5,076,292 | A | 12/1991 | Sensabaugh, Jr. et al. | |
| 2003/0205235 | A1 | 11/2003 | Draghetti et al. | |
| 2009/0065011 | A1* | 3/2009 | Maeder | A24F 47/006 131/194 |

FOREIGN PATENT DOCUMENTS

| | | | | |
|---|---|---|---|---|
| CN | 102271543 | A | 12/2011 | |
| EP | 0 280 262 | A2 | 8/1988 | |
| EP | 1 688 052 | A1 | 8/2006 | |
| EP | 2 210 509 | A1 | 7/2010 | |
| GB | WO2010/076653 | A1 * | 7/2010 | A24F 47/00 |
| JP | 61-092558 | | 6/1986 | |
| JP | 62-166875 | | 10/1987 | |
| JP | 2010-535530 | | 11/2010 | |
| JP | 2012-513749 | | 6/2012 | |
| RU | 2 223 602 | C2 | 8/2004 | |
| TW | 200946241 | A1 | 11/2009 | |
| WO | WO 02/069745 | A1 | 9/2002 | |
| WO | 2009/007258 | A1 | 1/2009 | |
| WO | WO 2009/022232 | A2 | 2/2009 | |
| WO | WO 2010076653 | A1 * | 7/2010 | A24C 5/476 |

OTHER PUBLICATIONS

International Search Report dated Apr. 14, 2014 in PCT/EP13/075856 Filed Dec. 6, 2013.

Office Action dated Nov. 21, 2017 in Russian Patent Application No. 2015127081 (with English language translation of Combined Office Action and Search Report).

Combined Office Action and Search Report dated Jul. 25, 2017 in Taiwan patent application No. 102144802 (with English translation).

Chinese Office Action and Search Report with English translation dated Aug. 17, 2017 in corresponding Chinese Patent Application No. 201380063355.9, (22 pages).

Japanese Office Action with English translation dated Oct. 25, 2017 in corresponding Japanese Patent Application No. 2015-546042, (6 pages).

* cited by examiner

METHOD AND APPARATUS FOR MANUFACTURING SMOKING ARTICLE COMPONENTS HAVING A REMOVABLE WRAP

CROSS REFERENCE TO RELATED APPLICATION

This application is a U.S. national phase application under 35 U.S.C. § 371 of PCT/EP2013/075856, filed on Dec. 6, 2013, and claims the benefit of priority under 35 U.S.C. § 119 from prior EP Application No. 12196194.0, filed on Dec. 7, 2012, and from EP Application No. 12196395.3, filed on Dec. 10, 2012, the entire contents of each of which are incorporated herein by reference.

The present invention relates to a method of manufacturing components of a smoking article comprising a heat source and an aerosol-forming substrate, the smoking article having a removable wrap for protecting the heat source. The invention also relates to the corresponding apparatus for carrying out the method of manufacture.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by forced convection (i.e. puffing) and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of forced convective heating of the aerosol-forming substrate, at least one longitudinal airflow channel is provided through the combustible heat source.

Known heat sources are generally manufactured from brittle materials, such as a compressed particulate material, that may have a tendency to splinter, crumble, or fragment, during manufacture of smoking articles, during transportation, and during handling by the user. Such a break-down of the heat source may dirty other segments or components of the smoking article, other smoking articles, or the user with dust, which is undesirable.

Furthermore, known heat sources, especially when manufactured from compressed particulate material may absorb moisture from the atmosphere, depending on the atmospheric conditions, which may make the heat sources more susceptible to breaking, and, where the heat source is combustible, may make the heat source more difficult to ignite.

Methods of manufacturing such smoking articles are also known, in which all of the components or segments of the smoking article are covered by one outer wrapper. All of the components or segments of the smoking article are combined together in a combiner, and then wrapped in the outer wrapper. During manufacture of the smoking article, the combustible heat source is susceptible to breaking and crumbling and as such may soil or stain the other components or segments of the smoking article or other smoking articles.

Therefore, it is an object of the present invention to provide a method of manufacturing smoking articles, and components for smoking articles, having a heat source that reduces the susceptibility of breaking the heat source during manufacture, and reduces the risk of staining or soiling other smoking article components with dust or other particulate material from the heat source during manufacture.

According to the present invention, there is provided a method of manufacturing multi-segment components for smoking articles, each having a removable wrap. In one embodiment, the method comprises: feeding a stream of heat sources, aerosol-forming substrates and caps along a moving delivery path; compacting into groups at least one heat source, an aerosol-forming substrate and a cap, each group corresponding to at least one multi-segment component, each multi-segment component having a first end adjacent the heat source and a second end adjacent the aerosol-forming substrate and each cap having a first end and a second end positioned adjacent the heat source; wrapping the heat source, aerosol-forming substrate and cap of each group in a web of material, the web of material having spaced apart lines of weakness; and cutting the web of material at a position proximate to the first end of the multi-segment component and adjacent the first end of the cap, wherein at least a portion of the web of material forms a removable wrap, the wrap being removable by breaking the wrapper at the respective line of weakness, and wherein the removable wrap in combination with the cap forms a removable cap for protecting the heat source. In a preferred embodiment, the group comprising at least one heat source, an aerosol-forming substrate and a cap comprises one heat source and one aerosol-forming substrate, which form a discrete multi-segment component. Alternatively, the group comprising at least one heat source and an aerosol-forming substrate comprises two heat sources and one aerosol-forming substrate, which form a double multi-segment component. In this alternative embodiment, the double multi-segment component comprises a heat source at each end of the double multi-segment component, with the aerosol-forming substrate positioned between the heat sources. To form discrete multi-segment components, the method may further comprise cutting the double multi-segment component proximate to the longitudinal mid point of the aerosol-forming substrate.

Alternatively, the double multi-segment component may be cut into discrete multi-segment components during manufacture of smoking articles incorporating the multi-segment components.

According to a further aspect of the present invention, there is provided a method of manufacturing multi-segment components for smoking articles, each having a removable wrap, comprising: feeding a stream of heat sources, aerosol-forming substrates and elongate segments along a moving delivery path; compacting into groups at least one heat source, an aerosol-forming substrate and an elongate element, each group corresponding to at least one multi-segment component, each multi-segment component having a first end adjacent the heat source, a second end adjacent the aerosol-forming substrate and an elongate segment positioned at the second end; wrapping the heat sources, aerosol-forming substrates and elongate segments in a web of material, the web of material having spaced apart lines of weakness; and cutting the web of material at a position proximate to the first end of the discrete multi-segment component, wherein at least a portion of the web of material forms a removable wrap, the wrap being removable by breaking the wrapper at the respective line of weakness, and wherein the web of material is cut such that a portion of the elongate segment from one discrete multi-segment component in combination with the removable wrap from an adjacent multi-segment component, forms a removable cap.

Advantageously, by providing a web of material having spaced apart lines of weakness which combines with the cap or elongate segment to form a removable cap, the heat source of the multi-component segment may be protected more effectively during manufacture, transport and storage. By providing a protected heat source, the heat source may be less likely to break or crumble. Therefore, such a multi-segment component is less likely to soil or stain adjacent components, or adjacent smoking articles with dust or other particulates from the heat source. Thus, the removable cap acts to protect the other smoking articles or segments or components of other smoking articles from the heat source. The removable cap advantageously also helps to prevent or reduce the amount of damage that can occur to the heat source during manufacturing, packaging, handling, and storage.

Furthermore, where the heat source is a combustible heat source, the segments or components may be more easily compacted together because the problem of the heat source dirtying other smoking articles, or other segments or components of the smoking article is mitigated once the removable cap at least partially covers the heat source.

In a preferred embodiment, the method may further comprise aligning each line of weakness such that each is proximate to a respective heat source. Alternatively, each line of weakness may be aligned such that it is proximate to a respective portion of the aerosol-forming substrate, or any other segment of the multi-segment component.

As used herein, the term "proximate" refers to a feature, such as a line of weakness, being approximately transversely adjacent to a segment of the multi-segment component.

As used herein, the terms 'upstream' and 'front', and 'downstream' and 'rear', are used to describe the relative positions of components, or portions of components, of the smoking article in relation to the direction in which a user draws on the smoking article during use thereof. Smoking articles according to the invention comprise a mouth end and an opposed distal end. In use, a user draws on the mouth end of the smoking article. The mouth end is downstream of the distal end. The heat source is located at or proximate to the distal end.

As used herein, the term 'longitudinal' is in reference to the direction of length of the smoking article. The term "transverse" refers to a direction perpendicular to the longitudinal direction.

In the preferred embodiment, the line of weakness is preferably aligned proximate with the downstream end of the heat source. Alternatively, the line of weakness may be aligned proximate with a position along the longitudinal axis of the heat source, or along the longitudinal axis of the aerosol-forming substrate. In a further alternative embodiment, the line of weakness is aligned proximate with the downstream end of the aerosol-forming substrate or the upstream end of the aerosol-forming substrate. In a yet further alternative preferred embodiment, the line of weakness is positioned proximate to either the upstream edge or downstream edge of a heat conducting element. In certain preferred embodiments, the heat conducting element is provided over at least a portion of the heat source.

The method preferably comprises applying an adhesive remote from the line of weakness, to affix the wrapper to the heat source and the aerosol-forming substrate. By affixing the wrapper remote from the line of weakness, the line of weakness may be more easily broken when the user wants to remove the wrap. The adhesive may be provided in an elongate line extending from the first end of the multi-segment component to the second end of the multi-segment component. In embodiments where an additional segment is positioned at the second end of the multi-segment component, the elongate line of adhesive may extend to the end of the additional segment. The additional segment may be a tobacco plug, a diffuser, a transfer section, a filter segment, or any other such smoking article segment or component. When the adhesive is provided in an elongate line, the line of adhesive is interrupted proximate to the line of weakness. Alternatively, the adhesive may be provided on substantially the entire wrapper, and interrupted proximate to the line of weakness.

In the preferred embodiment, the spaced apart lines of weakness are arranged such that they circumscribe the discrete multi-segment component. That is to say, each line of weakness extends across the width of the web of material, such that when the web of material is wrapped around the components of the multi-segment component, each line of weakness is provided around the periphery of the multi-segment component. By providing lines of weakness arranged in this way, the removable wrap may be more easily removed without damaging the remaining wrapper.

Alternatively, or in addition, a further set of spaced apart lines of weakness are arranged such that they are substantially parallel to the longitudinal axis of the discrete multi-segment components. In this arrangement, the further lines of weakness are preferably positioned such that when the groups of components are cut into wrapped multi-segment components the further lines of weakness extend longitudinally from adjacent the first end towards the second end. By providing such a line of weakness, the user may more easily remove the wrap by first tearing along the longitudinal line of weakness, and then around the circumferential line of weakness. Each line of weakness in the further set of spaced apart lines of weakness may be formed using a laser or mechanically using a toothed wheel, a series of blades, a punch, or a combination of any of these methods. The method by which each line of weakness in the further set of spaced apart lines of weakness is formed may be the same or different from other lines of weakness that, for instance, circumscribe the circumferential perimeter of a group of components.

In this arrangement, the length of each line of weakness in the further set of spaced apart lines of weakness may be at least about 50% of the length of the heat source. That is to say, each line of weakness extends along the heat source for at least 50% of the longitudinal length of the heat source. In this way, when the wrap is removed by the user, at least 50% of the heat source is exposed. More preferably, the length of the line of weakness extends between about half to two-third of the length of the heat source. In alternative preferred embodiments the length of the line of weakness extends at least about 75% of the length of the heat source. Preferably, the length of the line of weakness should extend no more than about 85% of the heat source.

In this arrangement, each line of weakness in the further set of spaced apart lines of weakness may intersect or merge with a line of weakness of the spaced apart lines of weakness. Alternatively, each line of weakness in the further set of spaced apart lines of weakness may terminate proximate to a line of weakness of the spaced apart lines of weakness. The length of each line of weakness in the further set of spaced apart lines of weakness may be from about 3 mm to about 13 mm, more preferably from about 5 mm to about 10 mm, and most preferably about 8 mm.

In certain preferred embodiments, each line of weakness in the further set of spaced apart lines of weakness comprises a plurality of perforations which extend along the smoking article. Alternatively, the line of weakness may comprise a scribed or scored line reducing the strength of the material, or a section of different, weaker, material. As a further alternative, the longitudinal line of weakness may comprise a cut extending through the entire thickness of the wrapper.

In this arrangement, each line of weakness may be linear or non-linear. The non-linear line of weakness may be a smooth wave, a triangular wave or any other suitable non-linear line. Preferably, the non-linear line comprises a semi-circle.

The method preferably further comprises applying a strip of material to the web of material adjacent each line of weakness configured to extend from an edge of the web of material, and across at least a portion of the web of material, wherein the strip of material forms a pull-tab for removing the removable wrap.

The strip of material may extend past the edge of the web of material by at least 5 mm, preferably by at least 10 mm. The strip of material may be made from plastic, metal, such as aluminium foil, or any other suitable material with sufficient tensile strength to tear the web of material when pulled. The strip of material may be in the form of a string, wire, or a long narrow-shaped piece.

In a preferred embodiment, the stream of caps comprises a stream of elongate elements, wherein each group corresponding to a multi-segment component further comprises an elongate segment positioned at the second end and wherein the step of cutting comprises cutting the web of material such that a portion of the elongate segment from one multi-segment component in combination with the removable wrap from an adjacent multi-segment component, forms the removable cap. In an alternative preferred embodiment, the stream of elongate segments is double-length, wherein each group comprising at least one heat source and an aerosol-forming substrate comprises two heat sources and two aerosol-forming substrates, and a double-length elongate segment, so as to form a double multi-segment component. In this alternative embodiment, the double multi-segment component comprises a heat source at each end of the double multi-segment component, with the aerosol-forming substrate adjacent each heat source, and the double-length elongate segment between the aerosol-forming substrate. To form discrete multi-segment components, the method may further comprise cutting the double multi-segment component proximate to the longitudinal mid point of the double-length elongate segment.

As used herein, the term "elongate segment" refers to any portion of a smoking article downstream from the aerosol-forming substrate, which adds to the length of the smoking article.

The removable cap may comprise a desiccant. The desiccant is provided to absorb moisture from the atmosphere to prevent or reduce the amount of moisture absorption by the heat source. Advantageously, reducing the amount of moisture absorbed by the heat source may provide a smoking article that is easier to light. The desiccant may be a substance that is soluble or insoluble in water, including but not limited to glycerin, calcium chloride, calcium sulfate, calcium oxide, aluminium sulfate, aluminium sulfate, Montmorillonite clay, silica gel, zeolites, molecular sieves, activated carbon, clay or any combination thereof. The desiccant may be provided on-line, that is to say during the process of manufacturing the multi-segment component, or more preferably, the removable cap is provided pre-loaded with desiccant before it is fed into the apparatus for forming the multi-segment components.

Advantageously, utilising a portion of a segment in the multi-segment component to form a portion of the removable cap enables a more efficient manufacturing process to be provided.

The method preferably further comprises perforating the web of material to form the lines of weakness. The perforations may be formed by, for example, a pulsing laser, a hot wire, or mechanically using a toothed wheel, a series of blades, a punch, or a combination of any of these methods.

A heat-conducting element may be provided between the web of material and the heat source. The heat conducting element provides a thermal link between the heat source and aerosol-forming substrate of smoking articles according to the invention. The heat conducting element is preferably combustion resistant and oxygen restricting. Suitable heat-conducting elements for use in smoking articles according to the invention include, but are not limited to: graphite sheet, metal foil wrappers such as, for example, aluminium foil wrappers, steel wrappers, iron foil wrappers and copper foil wrappers; and metal alloy foil wrappers. The heat-conducting element preferably overlays at least a portion of the heat source and at least a portion of the aerosol-forming substrate. The heat-conducting element may be affixed to the inner surface of the web of material using adhesive.

Alternatively or additionally, the heat-conducting element may be provided on the outer surface of the web of material.

Preferably, individual combustible heat sources are fed from a hopper. The combustible heat sources may be manufactured from a brittle material, such as a compressed particulate material, that may have a tendency to splinter, crumble, or fragment when cut with a conventional blade. Therefore, since the combustible heat sources are not cleanly cuttable, advantageously, the present method provides the combustible heat sources individually. The combustible heat sources are preferably substantially cylindrical and comprise a heat conductive back-coating on one end face. The method preferably comprises aligning the combustible heat sources, within the hopper, such that the combustible heat sources are fed onto the moving delivery path with the back-coating of each combustible heat source in substantially the same orientation.

Each heat source may be a carbonaceous or carbon-based heat source. Preferably, the heat source is cylindrical. In that case, each heat source on the delivery path preferably has its longitudinal axis substantially aligned with the direction of movement of the delivery path. The heat source may optionally include one or more airflow channels therethrough.

In the preferred embodiment, the heat source is preferably a combustible heat source. In an alternative embodiment, the heat source may be a chemical heat source, or any other suitable heat source for a smoking article that may need protection from environmental conditions during manufacture or storage. In certain embodiments, for instance, the chemical heat source may be activated upon exposure to the atmosphere. Specifically, the chemical heat source may be activated upon exposure to air, or more particularly oxygen, or any other suitable constituent in the air. In this alternative embodiment, the removable cap is particularly advantageous because it may substantially isolate the heat source from the atmosphere.

In embodiments where the heat source is a combustible heat source, to isolate the combustible heat source from air drawn through the smoking article, smoking articles according to the invention may comprise a non-combustible, substantially air impermeable, barrier between a downstream end of the combustible heat source and an upstream end of the aerosol-forming substrate.

As used herein, the term 'non-combustible' is used to describe a barrier that is substantially non-combustible at temperatures reached by the combustible heat source during combustion or ignition thereof.

The barrier may abut one or both of the downstream end of the combustible heat source and the upstream end of the aerosol-forming substrate.

The barrier may be adhered or otherwise affixed to one or both of the downstream end of the combustible heat source and the upstream end of the aerosol-forming substrate.

Where a heat conducting element is provided, preferably, the front portion of the aerosol-forming substrate surrounded by the heat conducting element is between about 2 mm and about 10 mm in length. Preferably, the rear portion of the aerosol-forming substrate not surrounded by the heat conducting element is between about 3 mm and about 10 mm in length. In other words, the aerosol-forming substrate preferably extends between about 3 mm and about 10 mm downstream beyond the heat conducting element.

In yet further embodiments, the entire length of the aerosol-forming substrate may be surrounded by a heat-conducting element.

Preferably, smoking articles manufactured according to the invention comprise aerosol-forming substrates comprising a material capable of emitting volatile compounds in response to heating. Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

In a preferred embodiment, the aerosol-forming substrate further comprises at least one aerosol-former. The at least one aerosol-former may be any suitable known compound or mixture of compounds that, in use, facilitates formation of a dense and stable aerosol and that is substantially resistant to thermal degradation at the operating temperature of the aerosol-generating article.

Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as triethylene glycol, 1,3-butanediol and, most preferred, glycerine.

In certain alternative preferred embodiments, the aerosol-forming substrate may be non-plant based. In such embodiments, the aerosol-forming substrate may be made from any material that is capable of being impregnated with a volatile compound in response to heating, and is thermally stable at the temperature range reached upon heating by the heat source. Volatile compounds, such as nicotine, flavourants, and other aerosol modifiers and additives or combinations thereof, may be incorporated into the non-plant based aerosol-forming substrate.

As described above, preferably, the heat source is a combustible heat source. More preferably, the combustible heat source is a carbonaceous heat source. As used herein, the term 'carbonaceous' is used to describe a combustible heat source comprising carbon.

Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles manufactured according to the invention may have a carbon content of at least about 50 percent, preferably of at least about 60 percent, more preferably of at least about 70 percent, most preferably of at least about 80 percent by dry weight of the combustible carbon-based heat source.

Smoking articles manufactured according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

Instead of, or in addition to one or more binders, combustible heat sources for use in smoking articles manufactured according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

According to a further aspect of the present invention, there is provided a method of manufacturing multi-segment components for smoking articles, each having a removable wrap, comprising: feeding a stream of heat sources and aerosol-forming substrates along a moving delivery path; compacting into groups at least one heat source and an aerosol-forming substrate, each group corresponding to at least one multi-segment component, each multi-segment component having a first end adjacent the heat source and a second end adjacent the aerosol-forming substrate; wrapping the heat sources and aerosol-forming substrates in a web of material, the web of material having spaced apart lines of weakness; and cutting the web of material at a position proximate to the first end of the discrete multi-segment component, wherein at least a portion of the web of material forms a removable wrap, the wrap being removable by breaking the wrapper at the respective line of weakness.

In a preferred embodiment, the method further comprises: feeding a stream of elongate segments along the moving delivery path, wherein each group corresponding to a discrete multi-segment component further comprises an elongate segment positioned at the second end; wherein, the web of material is cut such that a portion of the elongate segment from one discrete multi-segment component in combination with the removable wrap from an adjacent multi-segment component, forms a removable cap.

According to a further aspect of the present invention, there is provided a method of manufacturing smoking articles. The method comprises feeding a stream of first multi-segment component manufactured as described herein, onto a receiving means; feeding a stream of second multi-segment components, each comprising at least a mouthpiece, onto the receiving means; and combining a first multi-segment component and a second multi-segment component by wrapping at least a portion of the first multi-segment component and the second multi-segment component in a web material to form an individual smoking article having a removable wrap at a distal end and a mouthpiece at a proximal end.

In one embodiment, during the step of combining the first multi-segment component and the second multi-segment component, the first multi-segment component is further wrapped with a heat conducting element, wherein said line of weakness and the heat conducting element are positioned such that they do not overlap. In certain preferred embodiments, the heat conducting element comprises heat-reflective material.

In an alternative embodiment, a heat conducting element is wrapped around at least a downstream portion of the heat source, and at least an upstream portion of the aerosol-forming substrate before combining the first multi-segment component and the second multi-segment component.

In a further alternative embodiment, a heat source and aerosol-forming substrate are compacted to form a group, which is wrapped in a web of material having a line of weakness, which is aligned to overlap with the heat conducting element. Preferably, the line of weakness circumscribes the circumferential perimeter of the group. In a yet further alternative embodiment, the step of providing a wrapper having spaced apart lines of weakness may be provided during the step of combining the first and second multi-segment components. In this embodiment, the web material used to combine the first and second multi-segment components comprises the spaced apart lines of weakness. As will be appreciated, method steps described above in relation to forming a multi-segment component having a removable wrap apply equally to this yet further alternative embodiment.

According to a yet further aspect of the present invention, there is provided apparatus for manufacturing multi-segment components for smoking articles, each having a removable wrap. The apparatus is suitable for carrying out the method as described above. The apparatus comprises: a feeder for feeding a stream of heat sources, aerosol-forming substrates and caps along a moving delivery path; a compactor for compacting into groups at least one heat source, an aerosol-forming substrate and a cap, each group corresponding to at least one multi-segment component, each multi-segment component having a first end adjacent the heat source and a second end adjacent the aerosol-forming substrate and each cap having a first end and a second end positioned adjacent the heat source; means for wrapping the heat sources, aerosol-forming substrates and caps in a web of material, the web of material having spaced apart lines of weakness; and a cutter for cutting the web of material at a position proximate to the first end of the discrete multi-segment component and adjacent the first end of the cap, wherein at least a portion of the web of material forms a removable wrap, the wrap being removable by breaking the wrapper at the respective line of weakness, and wherein the removable wrap in combination with the cap forms a removable cap for protecting the heat source.

The apparatus may further comprise means for aligning each line of weakness such that each is proximate to a desired segment, component, or portion of a segment of the smoking article. For example, in certain preferred embodiments, the apparatus may comprise means for aligning each line of weakness such that each is proximate to the downstream end of the heat source or heat conducting element. Alternatively, the apparatus may comprise means for aligning each line of weakness such that each line of weakness is aligned with a position along the longitudinal axis of the heat source, the aerosol-forming substrate, or the heat conducting element. In a further alternative embodiment, the line of weakness is aligned with the downstream end of the aerosol-forming substrate. In a yet further alternative preferred embodiment, the line of weakness is positioned adjacent to either the upstream edge or downstream edge of the heat conducting element.

According to a further aspect of the present invention, there is provided an apparatus for manufacturing multi-component segments for smoking articles, each having a removable wrap, the apparatus comprising: a feeder for feeding a stream of heat sources, aerosol-forming substrates and elongate segments along a moving delivery path; a compactor for compacting into groups at least one heat source, an aerosol-forming substrate and an elongate segment, each group corresponding to at least one multi-segment component, each multi-segment component having a first end adjacent the heat source, a second end adjacent the aerosol-forming substrate and an elongate segment positioned at the second end; means for wrapping the heat sources, aerosol-forming substrates and elongate segments in a web of material, the web of material having spaced apart lines of weakness; and a cutter for cutting the web of material at a position proximate to the first end of the discrete multi-segment component, wherein at least a portion of the web of material forms a removable wrap, the wrap being removable by breaking the wrapper at the respective line of weakness, such that a portion of the elongate segment from one discrete multi-segment component in combination with the removable wrap from an adjacent multi-segment component, forms a removable cap.

According to a still further aspect of the present invention, there is provided an apparatus for manufacturing smoking articles, each having a removable wrap. The apparatus comprises: a feeder for feeding a stream of first multi-component segments manufactured using the apparatus as described herein; a feeder for feeding a stream of second multi-segment components, each comprising at least a mouthpiece, onto a receiving means; and a combiner for combining a first multi-segment component and a second multi-segment component, the combiner comprising: means for wrapping at least a portion of the first multi-segment component and the second multi-segment component in a web material to form an individual smoking article having a removable wrap at a distal end and a mouthpiece at a proximal end.

Smoking articles manufactured according to the invention may also further comprise an expansion chamber upstream of the mouthpiece. The expansion chamber is provided in the second multi-segment component. Preferably, the mouthpiece is of low filtration efficiency, more preferably of very low filtration efficiency. The mouthpiece may be a single segment mouthpiece. Alternatively, the mouthpiece may be a multi-segment, component, mouthpiece.

The mouthpiece may, for example, comprise a filter made of cellulose acetate, paper or other suitable known filtration materials. Alternatively or in addition, the mouthpiece may comprise one or more segments comprising absorbents, adsorbents, flavourants, and other aerosol modifiers and additives or combinations thereof.

Each feature disclosed in the description, and (where appropriate) the claims and drawings may be provided independently or in any appropriate combination. The invention extends to methods and/or apparatus substantially as herein described with reference to the accompanying drawings.

Any apparatus feature as described herein may also be provided as a method feature, and vice versa. As used herein, means plus function features may be expressed alternatively in terms of their corresponding structure, such as a suitably programmed processor and associated memory.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

Embodiments of smoking articles manufactured according to the present invention will now be further described, by way of example only, with reference to the accompanying drawing in which.

Figure 1:
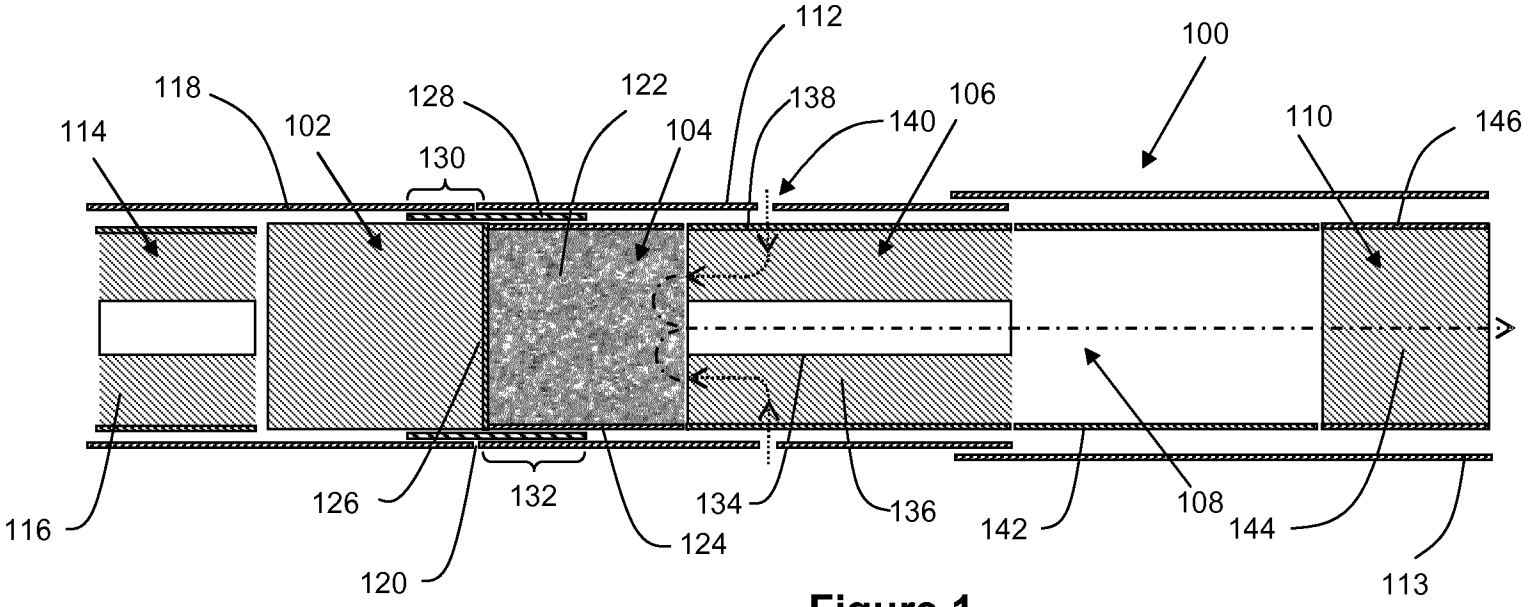
FIG. 1 shows a schematic representation of a smoking article manufactured according to a preferred embodiment of the invention.

The smoking article 100 manufactured according to one embodiment of the method of the present invention is shown in FIG. 1. The process is described in detail below with reference to the following features of the smoking article. The smoking article comprises a combustible carbonaceous heat source 102, an aerosol-forming substrate 104, an airflow directing element 106, an expansion chamber 108 and a mouthpiece 110 in abutting coaxial alignment. The combustible carbonaceous heat source 102, aerosol-forming substrate 104, and airflow directing element 106 are formed as a first multi-segment component wrapped in wrapper 112, and the elongate expansion chamber 108 and mouthpiece 110 are formed as a second multi-segment component. The first and second multi-segment components are overwrapped in an outer wrapper 113 of cigarette paper of substantially low air permeability.

A removable cap 114 is provided at the distal end of the smoking article 100, and is directly adjacent to the heat source 102. The removable cap 114 comprises a central portion 116, and is wrapped in a portion 118 of the wrapper 112. In the embodiment shown, the central portion 116 comprises a desiccant, such as glycerine, provided to preferentially absorb moisture from the atmosphere in the proximity of the combustible heat source, so as to reduce or prevent performance degradation of the combustible heat source upon lighting and use. The portion 118 of the wrapper is connected to the wrapper 112 at a line of weakness 120. The line of weakness comprises a plurality of perforations that circumscribe the smoking article 100.

The aerosol-forming substrate 104 is located immediately downstream of the combustible carbonaceous heat source 102 and comprises a cylindrical plug 122 of tobacco material comprising glycerine as an aerosol former and circumscribed by plug wrap 124.

A non-combustible, substantially air impermeable barrier 126 is provided between the downstream end of the combustible heat source 102 and the upstream end of the aerosol-forming substrate 104. As shown in FIG. 1, the non-combustible, substantially air impermeable barrier consists of a non-combustible, substantially air impermeable, barrier coating 126, which is provided on the entire rear face of the combustible carbonaceous heat source 102.

A heat conducting element 128 consisting of a layer of aluminium, preferably aluminium foil, surrounds and is in direct contact with a rear portion 130 of the combustible carbonaceous heat source 102 and an abutting front portion 132 of the aerosol-forming substrate 104. As shown in FIG. 1, a rear portion of the aerosol-forming substrate 104 is not surrounded by the heat conducting element 128. In an alternative embodiment not shown, a second heat-conducting element wraps around at least a portion of the heat-conducting element 128. At least part of the second heat-conducting element is radially separated from the heat-conducting element 128 by one or more layers of a heat insulative material, such as paper.

As shown in FIG. 1, the portion 118 of the outer wrapper which forms part of the removable cap overlays the rear portion 130 of the heat source 102.

The airflow directing element 106 is located downstream of the aerosol-forming substrate 104 and comprises an open-ended, substantially air impermeable hollow tube 134 made of, for example, cardboard, which is of reduced diameter compared to the aerosol-forming substrate 104. The upstream end of the open-ended hollow tube 134 abuts the aerosol-forming substrate 104. The open-ended hollow tube 134 is circumscribed by an annular air permeable diffuser 136 made of, for example, cellulose acetate tow, which is of substantially the same diameter as the aerosol-forming substrate 104.

The open-ended hollow tube 134, and annular air permeable diffuser 136 may be separate components that are adhered or otherwise connected together to form the airflow directing element 106 prior to assembly of the smoking article 100. For example, the open-ended hollow tube and annular air permeable diffuser may be parts of a single hollow tube of air permeable material having a substantially air impermeable coating applied to its inner surface.

In a particularly preferred embodiment, the central portion 116 of the removable cap 114 is manufactured from the same material as the airflow directing element, and so comprises an open-ended hollow tube.

As shown in FIG. 1, the open-ended hollow tube 134 and annular air permeable diffuser 136 are circumscribed by an air permeable inner wrapper 138.

As also shown in FIG. 1, a circumferential arrangement of air inlets 140 is provided in the wrapper 112 circumscribing the inner wrapper 138.

The second multi-segment component comprises the expansion chamber 108 which is located downstream of the airflow directing element 106 and comprises an open-ended hollow tube 142 made of, for example, cardboard, which is of substantially the same diameter as the aerosol-forming substrate 104.

The second multi-segment component also comprises the mouthpiece 110 of the smoking article 100, which is located downstream of the expansion chamber 108 and comprises a cylindrical plug 144 of cellulose acetate tow of very low filtration efficiency circumscribed by filter plug wrap 146. The first multi-segment component and the second multi-segment component are circumscribed by the outer wrapper 113, such as a tipping paper.

According to the preferred embodiment, the first multi-segment component is manufactured by feeding individual combustible heat sources 102 from a hopper onto a moving delivery path. Aerosol-forming substrates and airflow directing elements are also fed into the moving delivery path, and are compacted together with individual combustible heat sources to form discrete multi-segment components. Each discrete multi-segment component is directly adjacent a further multi-segment component, and no gap is required.

The discrete multi-segment components are wrapped in a web of material that is provided with spaced apart lines of weakness. The lines of weakness comprise a plurality of perforations which are formed before the step of wrapping the multi-segment components using a laser. Alternatively, the lines of weakness may be formed mechanically, using, for example, a toothed wheel, a series of blades, a punch, or a combination of any of these methods. Alternatively, the perforations may be formed after the wrapping step.

An adhesive is provided on the inner surface of the web material to affix the web of material to the components of the multi-segment components. The adhesive is interrupted in the region proximate to the lines of weakness to enable the removable cap to be removed more easily.

Figure 2:
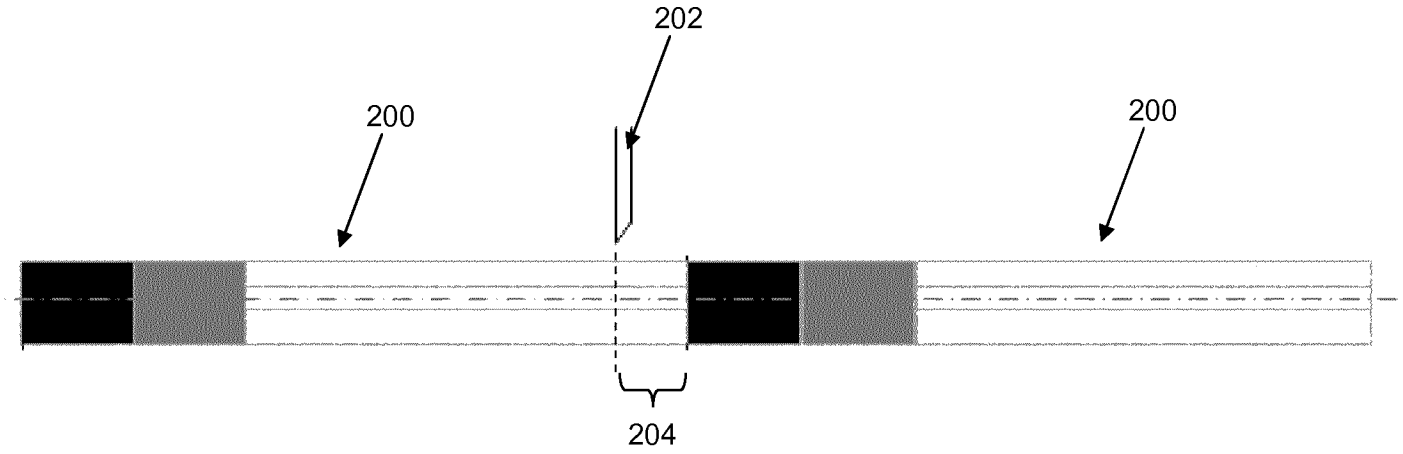
FIG. 2 shows a schematic representation of a portion of the manufacturing process according to the preferred embodiment of the present invention.

As can be seen in FIG. 2, the continuously wrapped series of discrete multi-segment components 200 are cut using cutter 202 to form individual multi-segment components. The cutter is oriented such that a portion 204 of the airflow directing element is cut at the first, distal, end of the multi-segment component, thus forming a removable cap, affixed to the multi-segment component at the line of weakness. In this way, an efficient manufacturing process is provided.

The first multi-segment components 200 are each then combined with further, second, multi-segment components which comprise an expansion chamber and a mouthpiece. The first and second multi-segment components are combined feeding a continuous stream of first and second multi-segment components into a moving delivery path, compacting the first and second multi-segment components together, and then by wrapping both components in an outer wrapper, such as tipping paper to join them together. In this way, a smoking article having a removable cap is provided.

Figure 4:
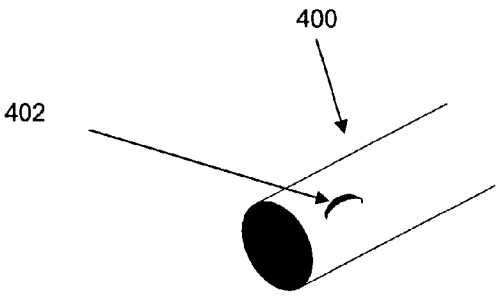
FIG. 4 shows a further embodiment of a smoking article manufactured according to the invention.
Figure 3:
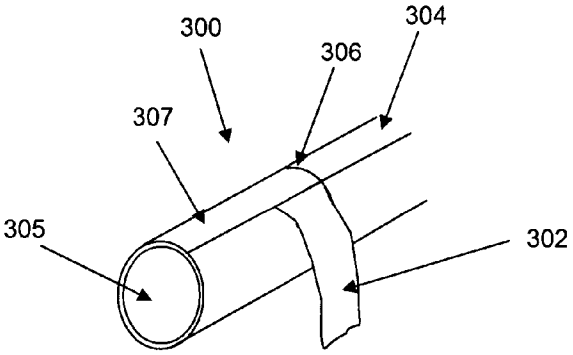
FIG. 3 shows an embodiment of a smoking article manufactured according to the invention.

As can be seen in FIGS. 3, 4 and 5, further embodiments of removable wraps on smoking article multi-segment components are provided. The embodiments shown in FIGS. 3, 4 and 5 are manufactured in a similar manner to the embodiment of FIG. 1 described above.

FIG. 3 shows a first multi-segment component 300 comprising a tear-tab 302 provided between the wrapper 304 and the heat source 305. The tear tab is provided adjacent the line of weakness 306, and enables the user to more easily remove the removable wrap portion 307 of the wrapper 304. The multi-component segment shown in FIG. 3 is manufactured by provided a strip of material, such as aluminium foil, on the inner surface of the web of wrapper material before the components, such as the heat source, aerosol-forming substrate and airflow directing element are wrapped. The strips of material may be aligned with pre-formed lines of weakness, or the lines of weakness may be subsequently formed after the wrapping step in a similar way to that described above.

FIG. 4 shows a further embodiment of a multi-component segment 400, in which a non-linear cut 402 is provided in the wrapper which extends from the distal end of the multi-segment component to the line of weakness. The non-linear cut, in this embodiment, is in the shape of a semi-circle. The cut provides a tear tab, and enables the user to more easily remove the removable wrap. The non-linear cut extends substantially parallel to the longitudinal axis of the multi-segment component.

Figure 5B:
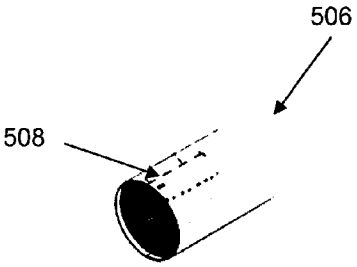
FIG. 5 shows a yet further embodiment of a smoking article manufactured according to the invention.
Figure 5A:
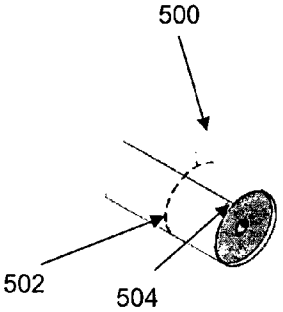

FIGS. 5*a* and 5*b* show further multi-segment components manufactured according to an embodiment of the present invention. The multi-segment component 500 shows the line of weakness 502 provided in the wrapper. In use, the user removes the removable wrap portion by tearing the wrapper along the tear line starting at the free end 504, as shown. The multi-segment component 506 shows a line of weakness 508 that extends linearly from the distal end of the multi-segment component. In use, the user removes the removable wrap by tearing the wrapper from the distal end towards the proximal end of the multi-segment component, and then subsequently tearing the wrapper circumferentially around the multi-segment component. In further embodiments (not shown), the line of weakness 502 in the wrapper is provided in combination with a line of weakness 508 that extends longitudinally from the distal end of the multi-segment component. In use, the user removes the removable wrap by tearing the wrapper along the line of weakness 508 from the distal end towards the proximal end of the multi-segment component, and then subsequently tearing the wrapper circumferentially along the line of weakness 502 and around the multi-segment component.

The invention claimed is:

1. A method of manufacturing multi-segment components for smoking articles, each having a removable wrap, comprising:

feeding a stream of heat sources, aerosol-forming substrates, and caps along a moving delivery path;

compacting into groups at least one heat source, an aerosol-forming substrate, and a cap, each group corresponding to at least one multi-segment component, each multi-segment component having a first end adjacent the heat source and a second end adjacent the aerosol-forming substrate and each cap being disposed at the first end of the at least one multi-segment component and directly adjacent to the heat source;

wrapping the heat sources, aerosol-forming substrates and caps in a web of material, the web of material having spaced apart lines of weakness; and cutting the web of material at a position proximate to the first end of the at least one multi-segment component and adjacent the first end of the cap, wherein at least a portion of the web of material forms a removable wrap, the wrap being removable by breaking the wrapper at the respective line of weakness, and wherein the removable wrap in combination with the cap forms a removable cap for protecting the heat source.

2. A method of manufacturing multi-segment components for smoking articles, each having a removable wrap, comprising:

feeding a stream of heat sources, aerosol-forming substrates and elongate segments along a moving delivery path;

compacting into groups at least one heat source, an aerosol-forming substrate, and an elongate element, each group corresponding to at least one multi-segment component, each multi-segment component having a first end adjacent the heat source, a second end adjacent the aerosol-forming substrate and an elongate segment positioned at the second end;

wrapping the heat sources, aerosol-forming substrates and elongate segments in a web of material, the web of material having spaced apart lines of weakness; and cutting the web of material at a position proximate to the first end of the at least one multi-segment component, wherein at least a portion of the web of material forms a removable wrap, the wrap being removable by breaking the wrapper at the respective line of weakness, and wherein the web of material is cut such that a portion of the elongate segment from one of the at least one multi-segment components is cut at the second end of the multi-segment component, such that the cut portion of the elongate segment in combination with the removable wrap from an adjacent one of the at least one multi-segment components, forms a removable cap disposed at the first end of the adjacent multi-segment component and directly adjacent to the heat source of the adjacent multi-segment component.

3. The method according to claim 1, further comprising aligning each line of weakness such that each is proximate to a respective heat source.

4. The method according to claim 1, further comprising applying an adhesive remote from the line of weakness, to affix the wrapper to the heat source and the aerosol-forming substrate.

5. The method according to claim 1, wherein the spaced apart lines of weakness are arranged such that they circumscribe the at least one multi-segment component.

6. The method according to claim 1, wherein a further set of spaced apart lines of weakness are arranged such that they are substantially parallel to the longitudinal axis of the at least one multi-segment component.

7. The method according to claim 6, wherein the length of each line of weakness in the further set of spaced apart lines of weakness is at least about 50% of the length of the heat source.

8. The method according to claim 6, wherein each line of weakness is non-linear.

9. The method according to claim 1, further comprising applying a strip of material to the web of material adjacent each line of weakness configured to extend from an edge of the web of material, and across at least a portion of the web of material, wherein the strip of material forms a pull-tab for removing the removable wrap.

10. The method according to claim 1, further comprising perforating the web of material to form the lines of weakness.

11. A method of manufacturing smoking articles, comprising:

feeding a stream of first multi-component segments manufactured according to claim 1, onto a receiving means;

feeding a stream of second multi-segment components, each comprising at least a mouthpiece, onto the receiving means; and combining a first multi-segment component and a second multi-segment component by wrapping at least a portion of the first multi-segment component and the second multi-segment component in a web material to form an individual smoking article having a removable wrap at a distal end and a mouthpiece at a proximal end.

12. The method according to claim 11, wherein, during the step of combining the first multi-segment component and the second multi-segment component, the first multi-segment component is further wrapped with a heat conducting element, wherein said lines of weakness and the heat conducting element are positioned such that they do not overlap.

* * * * *